US006525254B2

(12) United States Patent
Tsutsumi

(10) Patent No.: US 6,525,254 B2
(45) Date of Patent: Feb. 25, 2003

(54) METHOD AND APPARATUS FOR MANAGING SAVING OF TONE CONTROL DATA

(75) Inventor: Satoru Tsutsumi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 88 days.

(21) Appl. No.: 09/816,988

(22) Filed: Mar. 22, 2001

(65) Prior Publication Data

US 2001/0027715 A1 Oct. 11, 2001

(30) Foreign Application Priority Data

Mar. 22, 2000 (JP) ..... 2000-079459

(51) Int. Cl.[7] ..... G10H 1/18; G10H 7/00
(52) U.S. Cl. ..... 84/615; 84/602; 84/622
(58) Field of Search ..... 84/600–602, 615, 84/622

(56) References Cited

U.S. PATENT DOCUMENTS 4,924,745 A * 5/1990 Kimpara et al. ..... 84/609
6,085,309 A * 7/2000 Okamura ..... 381/63
6,147,292 A * 11/2000 Ito ..... 84/615

FOREIGN PATENT DOCUMENTS

JP 3-121496 5/1991

* cited by examiner

*Primary Examiner*—Jeffrey Donels
(74) *Attorney, Agent, or Firm*—Morrison & Foerster LLP

(57) ABSTRACT

Tone control data are stored in a volatile first memory such as a RAM, and a color or other factor of a tone to be generated is set or controlled in accordance with the tone control data. User can set contents of the tone control data stored in the first memory. In response to the setting of the tone control data, the stored contents of the first memory are automatically transferred to and stored into a non-volatile second memory, at which time the tone control data are transferred to the second memory within an idle time period when no other operation is being carried out. A plurality of sets of the tone control data, updated at different time points, are stored in the second memory, and arrangements are also made such that, when an error occurs in the course of newest tone control data, data recovery can be made using the second newest set of the tone control data stored in the second memory.

21 Claims, 8 Drawing Sheets

METHOD AND APPARATUS FOR MANAGING SAVING OF TONE CONTROL DATA

BACKGROUND OF THE INVENTION

The present invention relates to an improved method and apparatus for managing saving of tone control data, such as tone color control data, which are suitably applicable, for example, to electronic musical instruments.

There have heretofore been known electronic musical instruments which generate various percussion instrument tones in response to user's beating on pads or the like. Generally, these electronic musical instruments are arranged in such a manner that parameters of tones corresponding to the pads can be set by a user as necessary and also individual tone color data can be saved in a flash memory or the like on the basis of predetermined user operations.

However, the above-mentioned conventional technique presents the following problems. Namely, if the user turns off the electronic musical instrument without saving newly-created tone color data, the tone color data, having been set with considerable amounts of time and effort, would be lost. Further, in case the user, by mistake, turns off the electronic musical instrument during data saving, the already-stored data in the flash memory or the like would be destroyed, which, at the worst, necessitates initialization of the data.

SUMMARY OF THE INVENTION

In view of the foregoing, it is therefore an object of the present invention to provide a management method and apparatus which can save tone control data, such as tone color control data, safely and reliably while still maintaining high tone quality.

In order to accomplish the above-mentioned object, the present invention provides a method for managing saving of tone control data, which comprises the steps of: receiving a performance event; instructing, in accordance with the performance event received by the step of receiving, generation of a tone based on tone control data stored in a first storage device; receiving a setting event; changing, in accordance with the received setting event, the tone control data stored in the first storage device; and transferring, within an idle time period when operations by the steps are not being carried out, the tone control data, changed by the step of changing, from the first storage device to a non-volatile second storage device.

The present invention also provides a method for managing saving of tone control data, which comprises the steps of: updating tone control data stored in a first storage device; storing the tone control data, updated by the step of updating, into a non-volatile second storage device, the second storage device storing a plurality of sets of the updated tone control data in order in which the tone control data have been updated by the step of updating; and storing, into the second storage device, identification information indicative of a newest one of the plurality of sets of the updated tone control data stored in the second storage device.

The present invention also provides a method for managing saving of tone control data, which comprises the steps of: updating tone control data stored in a first storage device; transferring the tone control data, updated by the step of updating, to a non-volatile second storage device; receiving a performance event; suspending, in response to reception of the performance event, a transfer of the tone control data being carried out by the step of transferring at the time of the reception of the performance event; instructing, in accordance with the received performance event, generation of a tone based on the tone control data stored in the first storage device; and resuming the transfer of the tone control data suspended by the step of suspending, after completion of the tone generation corresponding to the performance event.

The present invention also provides a method for managing saving of tone control data, which comprises the steps of: receiving a setting event; changing, in accordance with the received setting event, tone control data stored in a first storage device; and transferring the changed tone control data from the first storage device to a non-volatile second storage device, on condition that reception of the setting event has intermitted for more than a predetermined time.

The present invention also provides a method for managing saving of tone control data, which comprises the steps of: receiving a setting event in a predetermined one of a plurality of operation modes; changing, in accordance with the received setting event, tone control data stored in a first storage device; and transferring the changed tone control data from the first storage device to a non-volatile second storage device, when the predetermined operation mode is changed to another one of the operation modes.

The above-mentioned tone control data may be tone color data, or any other desired sort of data.

The present invention may be constructed and implemented not only as the method invention as discussed above but also as an apparatus invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, rather than a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF EMBODIMENTS

[Hardware Setup of Embodiment]

Figure 1:
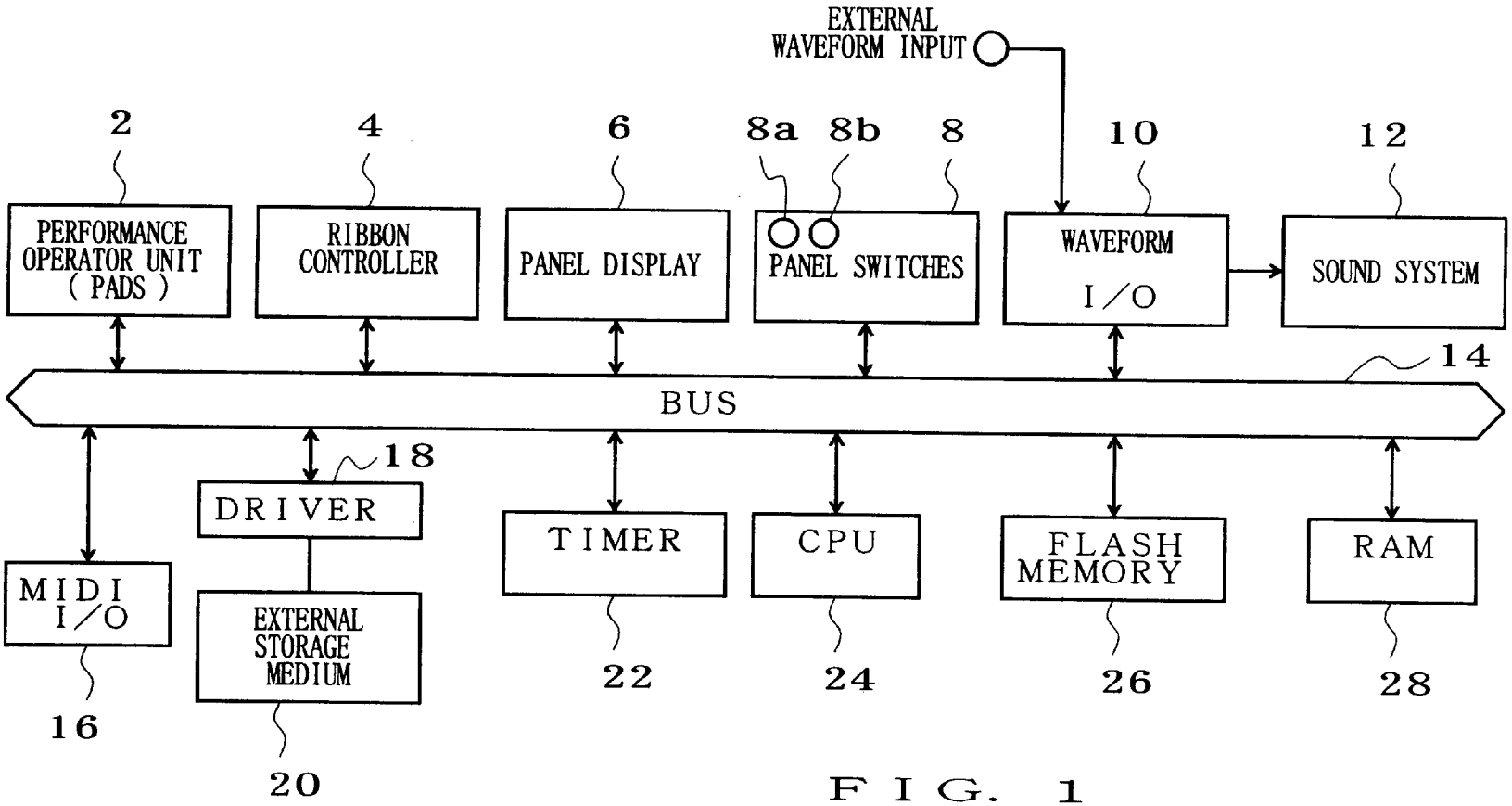
FIG. 1 is a block diagram showing a hardware setup of an electronic musical instrument in accordance with an embodiment of the present invention.

The following paragraphs describe an exemplary hardware setup of an electronic musical instrument in accordance with an embodiment of the present invention, with reference to FIG. 1. As shown, the electronic musical instrument includes a performance operator unit 2 having eight pads to be operated by a user or human player, and a ribbon controller 4 provided to perform an effect process, such as a vibrato effect, on a tone signal.

Reference numeral 6 represents a panel display that displays various information to the user, and 8 represents a group of panel switches to be used for setting tone color data and the like. The panel switch group 8 includes an address setting mode switch 8*a* and a play mode switch 8*b* for switching between operation modes. The panel switch group 8 also includes switches for switching between forward and backward directions of waveform data readout, and for giving an instruction whether or not a loop process should be performed, although not shown.

The electronic musical instrument also includes a waveform input/output section 10 which converts an externally-supplied tone signal into digital waveform data or converts a digital tone signal, generated in the electronic musical instrument, into an analog signal for audible reproduction via a sound system 12. Reference numeral 17 represents a MIDI interface for communication of a MIDI signal between external MIDI equipment and the electronic musical instrument. The electronic musical instrument also includes a CPU 24 that controls various components of the electronic musical instrument via a bus 14 and on the basis of later-described control programs. Reference numeral 20 represents an external storage medium such as a hard disk, MO (Magneto-Optical) disk or the like, and 18 represents a driver for delivering waveform data between the CPU 24 and the external storage medium 20. Further, reference numeral 22 represents a timer for issuing a time interrupt signal to the CPU 24 every predetermined time, 26 represents a flash memory unit. The flash memory unit 26 includes a first flash memory for storing a control program to be executed by the CPU 24, and a second flash memory for storing (saving) tone color data A and B (to be detailed later), waveform data allocated to the individual pads of the performance operator unit 2, etc. Further, reference numeral 28 represents a RAM that is used as various working areas for storing data during operation of the CPU 24.

[Data Organization Employed in the Embodiment]

[RAM 28]

Figure 2:
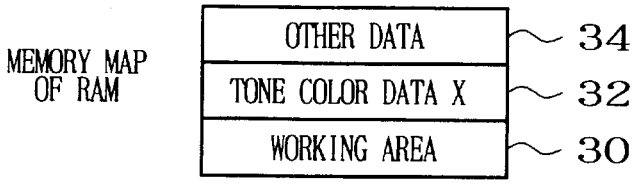
FIG. 2 is a diagram showing a memory map of a RAM in the embodiment of FIG. 1.

FIG. 2 shows a memory map of the RAM 28 employed in the embodiment. In FIG. 2, reference numeral 30 represents one of the working areas of the RAM 28, where various data are stored as the CPU 24 runs the control program of the electronic musical instrument. Reference numeral 32 represents a tone color data area where are stored tone color data X to be used for tone generation; the tone color data X comprise a set of tone color data corresponding to the eight pads of the performance operator unit 2. Further, reference numeral 34 represents an area for storing other data, which is used for transferring the waveform data.

[Flash Memory Unit 26]

Figure 3:
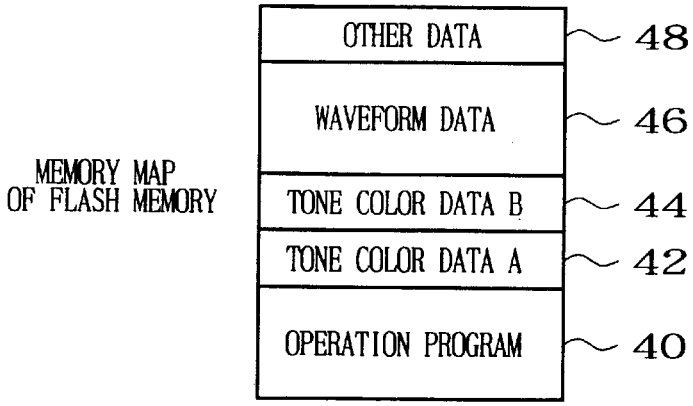
FIG. 3 is a diagram showing a memory map of a flash memory in the embodiment.

The following paragraphs describe a data format in the flash memory unit 26, with reference to FIG. 3. In FIG. 3, reference numeral 40 represents an operation program area which stores the later-described control programs of the electronic musical instrument. Reference numerals 42 and 44 represent tone color data areas which store tone color data A and tone color data B, respectively. Here, the tone color data A and B are organized in a similar manner to the above-mentioned tone color data X. Namely, the two tone color data areas 42 and 44 are provided within the flash memory unit 26, in corresponding relation to the tone color data area 32 of the RAM 28, so as to save the tone color data.

The tone color data areas 42 and 44 are similar in construction to the tone color data area 32 of the RAM 28, but different from the area 32 in that the areas 42 and 44 have flags AF and BF, respectively, indicative of their storage states. The flags AF and BF are each one-byte data, where values cyclically incremented every saving operation within a range of "0", "1", "2" and "3" are stored alternately. However, when the tone color data areas 42 and 44 are clear or entirely empty, the respective flags AF and BF are both set to a value "FF". In a waveform data area 46 of the flash memory unit 26, there are prestored waveform data of various percussion instruments. Various other data than the above-mentioned are stored in an other data area 48.

[Operation of the Embodiment]

[Main Routine]

Figure 4:
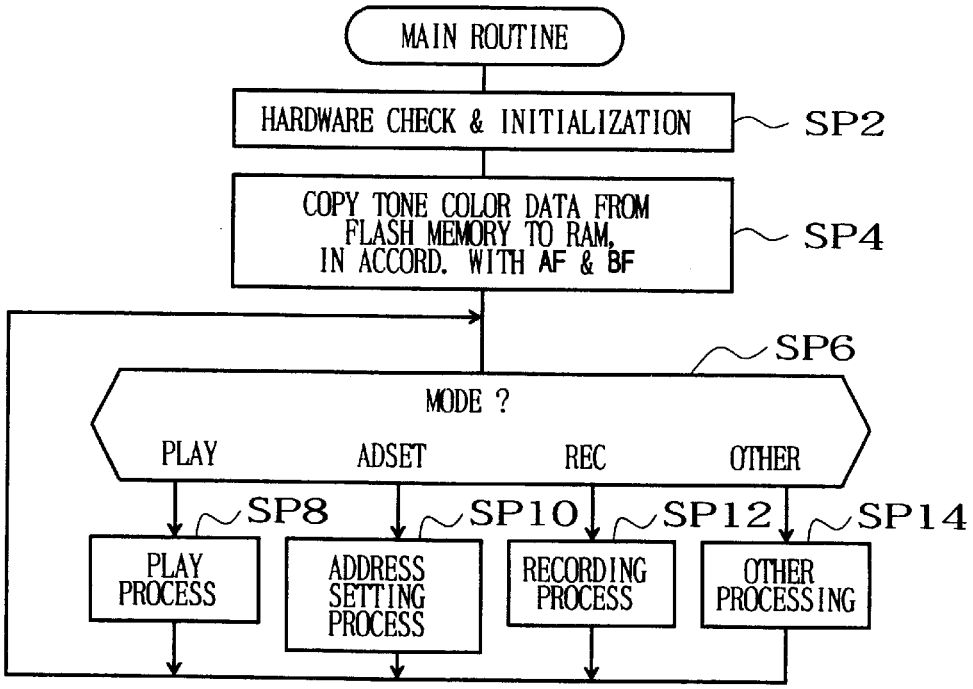
FIG. 4 is a flow chart of a main routine carried out in the embodiment.

Once the electronic musical instrument is turned on, a main routine as flow charted in FIG. 4 is started up. At step SP2, a check is made on the hardware of the electronic musical instrument, and various initialization operations are performed. At next step SP4, newest tone color data among tone color data A and B is loaded from the flash memory 26 into the tone color data area 32 of the RAM 28. Here, the "newest tone color data" is tone color data stored in either one of the tone color data areas 42 and 44 whose flag AF or BF is indicating a larger value than the other flag BF or AF; note that in this embodiment, the flag value "0" is regarded as greater than the value "3". In the event that one of the flags AF or BF is at the value "FF", the other flag BF or AF is considered to be indicating the newest tone color data. Current operation mode is detected at following step SP6 so that any one of processes of steps SP8 tp SP14 is carried out in accordance with the detected operation mode.

The operation modes of the instant embodiment are:

(1) "Play" mode where a tone waveform is synthesized on the basis of performance operations by the user or the like, and tone color data other than addresses of waveform data are set as necessary;

(2) "Address Setting" mode where a tone waveform is synthesized on the basis of performance operations by the user or the like, and addresses of waveform data are set as necessary;

(3) "Recording Process" mode where waveform data input via the waveform input/output section 10 are recorded into the flash memory unit 26;

(4) "Other Process" mode where other necessary processing is carried out.

Of the above-mentioned operation modes, the play mode and address setting mode are particularly characteristic of the instant embodiment and hence will be described in detail below in relation to various possible cases.

[Play Process (in the Case Where no Event Occurs in the Course of Data Transfer)]

Figure 5:
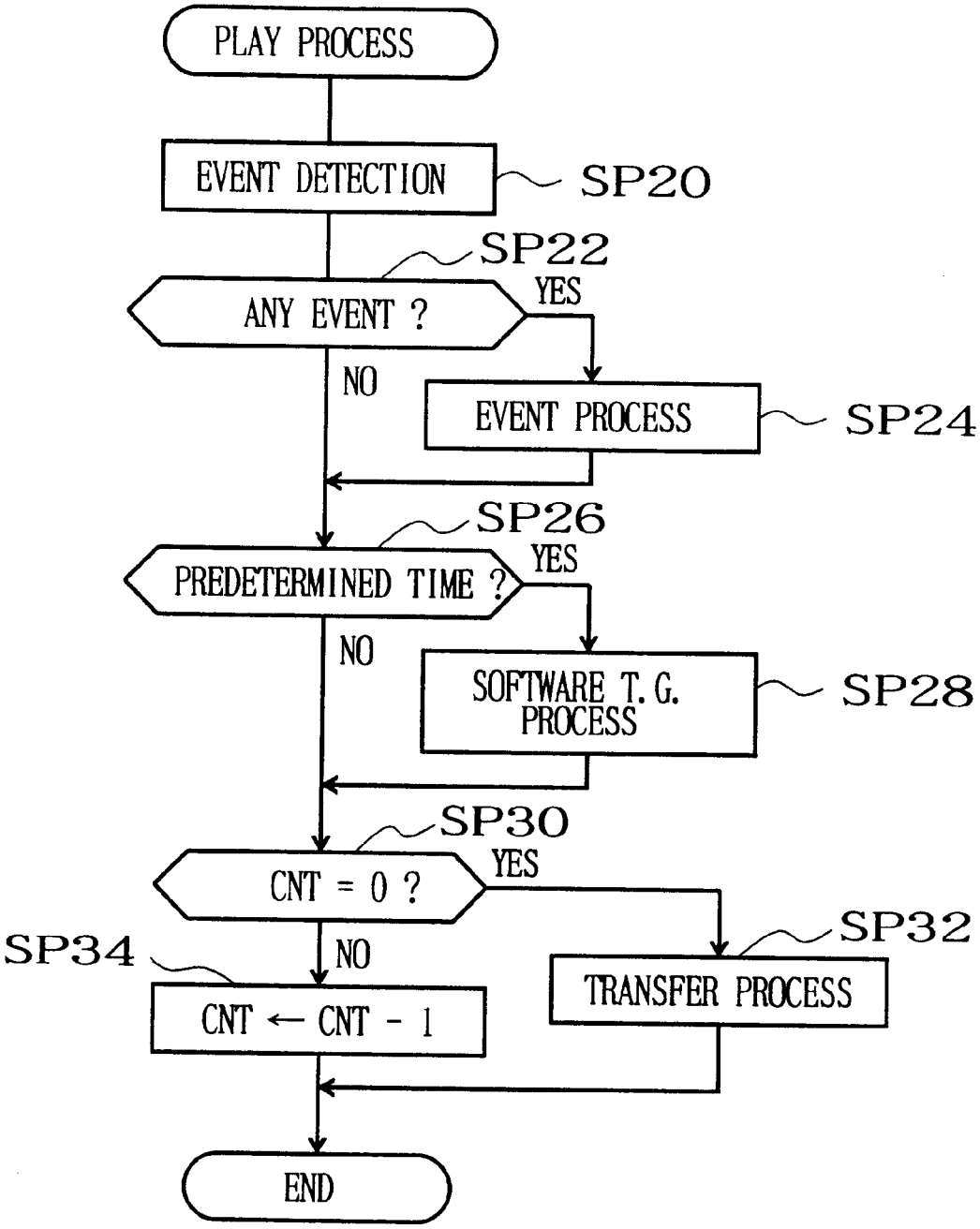
FIG. 5 is a flow chart of a play process subroutine carried out in the embodiment.

At the initial stage, the main routine goes to step SP8, because the operation mode has been set to the play mode. At step SP8, a play process subroutine of FIG. 5 is invoked. At step S20 of FIG. 5, the performance operator unit 2 and panel switches 8 are scanned so as to detect their operational states (depressed/released states).

Then, at step SP22, a determination is made as to whether there has been detected any event. The term "event" is used herein to refer not only to an event in the performance operator unit 2 and panel switches 8 but also to an event brought about by the CPU 24 as the CPU 24 carries out an automatic performance or other process. If answered in the affirmative at step SP22, the play process subroutine proceeds to step SP24 in order to execute an operation corresponding to the detected event. If, on the other hand, a negative (NO) determination is made at step SP22, the subroutine goes to step SP26 with the operation of step SP24 skipped.

At step SP26, a determination is made as to whether a predetermined time point for initiating a tone generator process has arrived or not. Namely, it is determined whether a predetermined time has elapsed from the time point when the initialization was performed last at step SP2 or from the time point when an operation of step SP28 was carried out last. With an affirmative (YES) determination at step SP26, the subroutine moves to step SP28 in order to carry out a software tone generator process. Namely, at step SP28, a tone waveform is synthesized for an appropriate time in a tone generating channel currently engaged in generation of a tone.

The thus-synthesized tone waveform is read out by the waveform input/output section 10 every sampling time and audibly reproduced or sounded via the sound system 12. However, when no tone generating channel is being engaged in tone generation as at the initial stage immediately after the power-on of the electronic musical instrument, no substantive operation is carried out at step SP8. Such an operation of step SP28 is similar to that executed by the well-known software tone generator. If the above-mentioned predetermined time point for initiating the tone generator process has not yet arrived, a negative determination is made at step SP26, so that the subroutine goes to step SP30 with the operation of step SP28 skipped.

Figure 9:
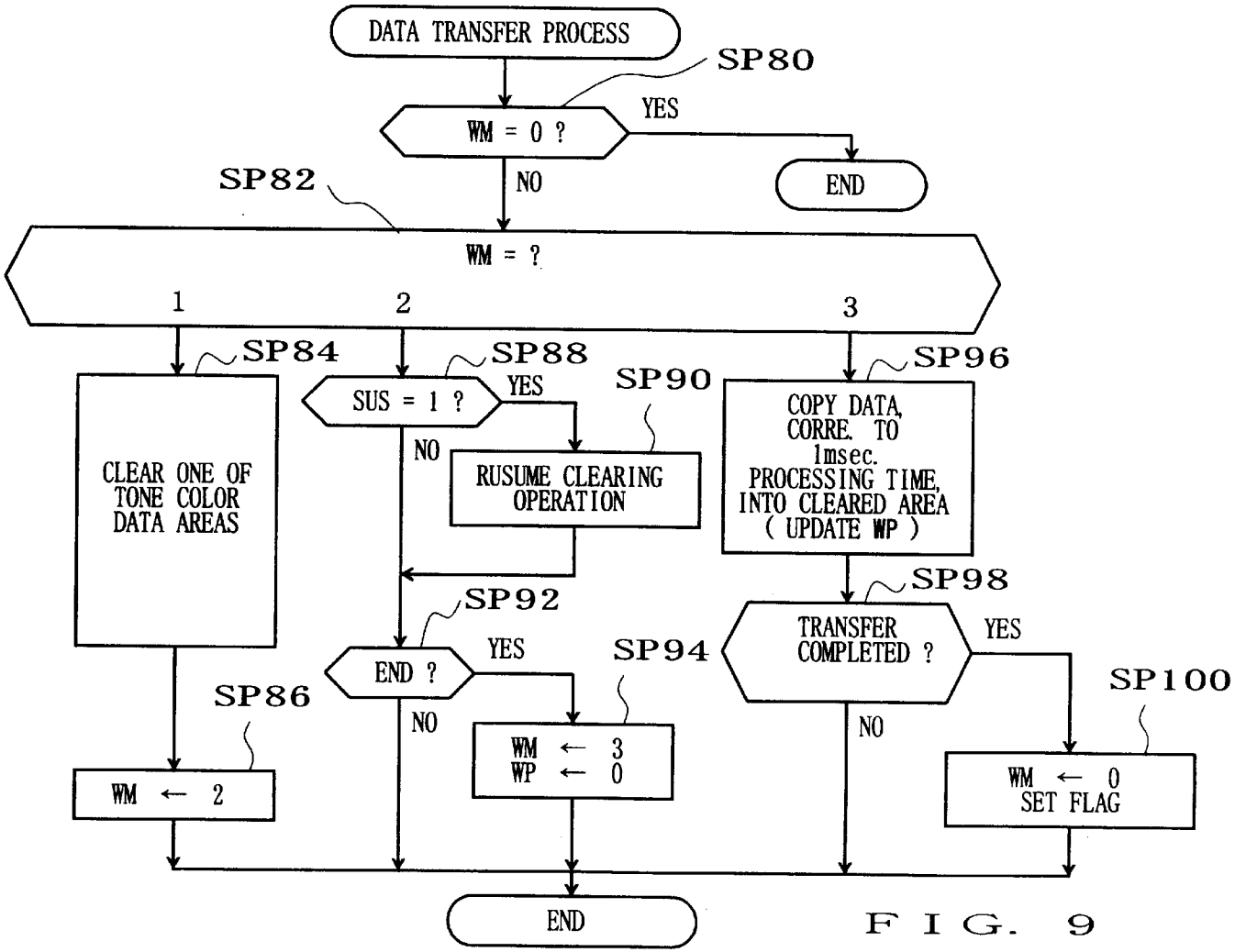
FIG. 9 is a flow chart of a data transfer process subroutine carried out when the embodiment is in the play mode.

At step SP30, a determination is made as to whether a variable CNT is "0" or not; note that the variable CNT has been initialized to "0" at step SP2 above. If answered in the affirmative at step SP30, a data transfer process subroutine of FIG. 9 is invoked. At step SP80 of FIG. 9, a determination is made as to whether a variable WM is "0" or not. The variable WM is indicative of a mode for writing to the flash memory unit 26. Namely, when the variable WM is "0", it indicates that the current mode is not the flash-memory writing mode, and when the variable WM is "1", it indicates that there is currently a request for writing to the flash memory unit 26. Further, when the variable WM is "2", it indicates that the flash memory unit 26 is now being cleared, and when the variable WM is "3", it indicates that data is being copied into the flash memory unit 26. This write mode variable WM too has already been initialized to "0" at step SP2 above. Thus, the data transfer process subroutine of FIG. 9 is immediately brought to an end, and control is returned to the main routine of FIG. 4 by way of the play process subroutine. After that, the above-mentioned operations will be repeated each time step SP8 is called in the main routine.

[Pad-ON Event Process]

Figure 6:
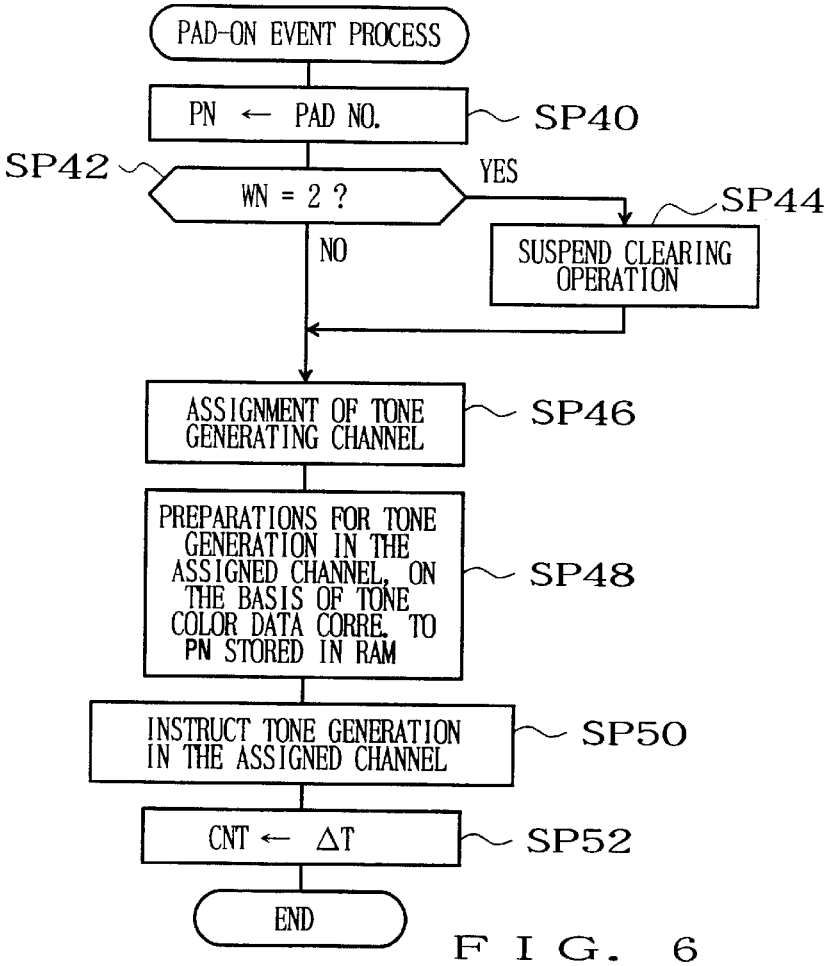
FIG. 6 is a flow chart of a pad-on event process routine carried out when the embodiment is in a play mode.

Once an ON event of any one of the eight pads in the performance operator unit 2 has been detected at step SP22, a pad-on event process is carried out at step SP24 as flow-charted in FIG. 6. At step SP40 of FIG. 6, a unique pad number (any one of numbers 1–8) of the pad having been turned on is substituted into a variable PN. At next step SP42, it is determined whether or not the write mode variable WM is "2" indicating that the flash memory unit 26 is now being cleared. If the write mode variable WM has been initialized to "0" as mentioned above, then a negative (NO) determination is made here at step SP42, so that the pad-on event process proceeds to step SP46. If, on the other hand, an affirmative (YES) determination is made at step SP42, an operation of step SP44 is executed as will be later described.

At step SP46, a tone generating channel is assigned to the detected pad-on event. Then, at step SP48, reference is made to the tone color data X stored in the RAM 28, and preparations are made for tone generation in the assigned tone generating channel on the basis of the stored tone color data corresponding to the pad number PN. At next step SP50, an instruction is issued for generating a tone in the assigned tone generating channel; specifically, a flag is set which permits the assigned tone generating channel to generate the tone. In this way, when the software tone generator process of step SP28 of FIG. 5 is invoked, a waveform synthesis process is performed on that channel.

After step SP50, the process moves on to step SP52, where a predetermined transfer wait time $\Delta T$ is substituted into the variable CNT. Following step SP52, control reverts to the play process subroutine of FIG. 5. After that, each time the play process subroutine is invoked, a negative determination is made (i.e., $CNT \neq 0$) at step SP30, so that the process goes from step SP30 to step SP34.

At step SP34, the variable CNT is decremented by one. Because, by the operation of step SP34 being repeated, the variable CNT is caused to again take the value "0" when the time period corresponding to the transfer wait time $\Delta T$ has passed, the transfer subroutine (FIG. 9) is invoked at step SP32. However, the write mode variable WM is "0" "indicating that there is no data to be written) at this time, so that the transfer subroutine is immediately brought to an end at step SP80. When the write mode variable WM is "0" like this, no particularly significant operation is performed in response to the count down of the variable CNT. In this situation, there are only carried out substantial operations for assigning a tone generating channel each time the user beats on one of the pads (step SP46 of FIG. 6) and for generating a tone based on waveform synthesis (step SP28 of FIG. 5).

[Data Change Event Process]

Figure 8:
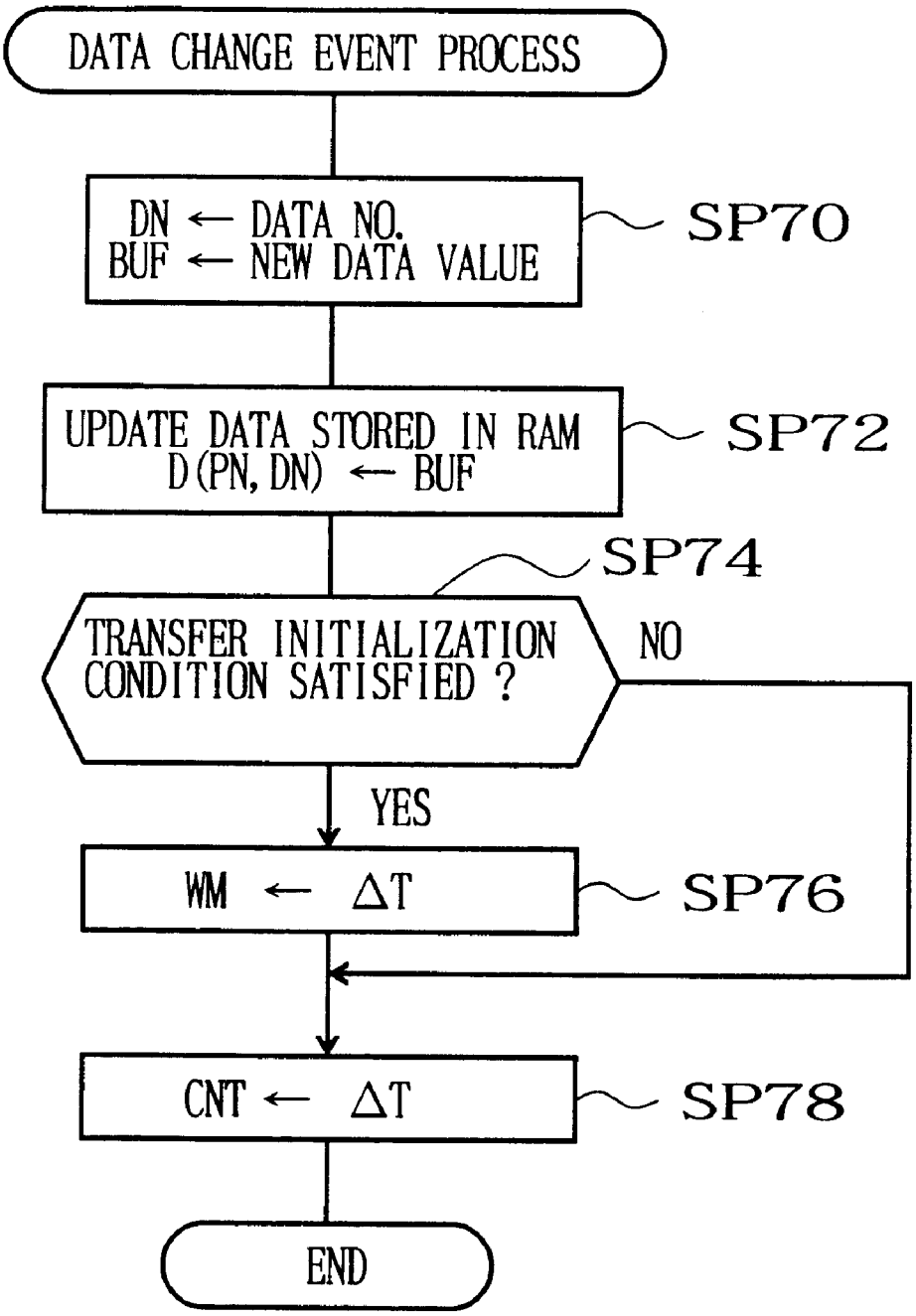
FIG. 8 is a flow chart of a data change event process routine carried out when the embodiment is in the play mode.

When any one of data change switches is operated by the user in the play mode, a data change event process routine is carried out, in response to detection of the event, at step SP24 of the play process subroutine of FIG. 5, as flow charted in FIG. 8.

At step SP70 of FIG. 8, a unique number corresponding to the operated data change switch is substituted into a variable DN (data number). Also, a value of the changed or new data is stored into a buffer area of the RAM 28. At next step SP72, the tone color data X stored in the RAM 28 are updated; that is, the stored contents in the buffer area are written into the RAM 28, as data related to the data number DN for the pad number PN.

As explained earlier in relation to step SP40 of the pad-on event process routine (FIG. 6), once an ON event of any one of the pads is detected, the pad number PN is updated with the unique number of that pad. Therefore, the operation of step S72 is nothing but "updating the data related to the last-operated data change switch for the last-operated pad".

After step SP72, the data change event process routine moves on to step SP74, where a determination is made whether a "transfer initialization condition" is satisfied or not. The transfer initialization condition is judged as "satisfied" in any one of the following two cases where:

(a) the write mode variable WM is "0" indicating that there is no data to be written into the flash memory unit 26; and (b) the write mode variable WM is "3" indicating that data is being copied into the flash memory unit 26, and a write pointer WP is not "0".

Because the write mode variable WM is "0" at this point, the transfer initialization condition is judged as "satisfied", i.e. an affirmative determination is made, at step SP74, so that the process proceeds to step SP76. At step SP76, the write mode variable WM is set to "1" indicating that there is currently a request for writing to the flash memory unit 26. Then, at next step SP 78, the transfer wait time ΔT is substituted into the variable CNT, after which the data change event process routine is terminated.

Then, when the play process subroutine of FIG. 5 is invoked, the operations of steps SP30 and SP34 are repeated a predetermined number of times corresponding to the transfer wait time ΔT. After that, once the variable CNT turns to "0" and the data transfer process subroutine of FIG. 9 is invoked, a negative determination is made at step S80, so that the subroutine proceeds to step SP82. At step SP82, the process branches depending on the value of the write mode variable WM. Because the write mode variable WM has been set earlier to "1" indicating that there is a request for writing to the flash memory 26, the process moves to step SP84, where an instruction is issued to the flash memory unit 26 to clear either one of the tone color data areas 42 and 44.

If a value in the range of "0" to "3" his not been set in one of the flags AF and BF, the data stored in the tone color data area 42 or 44 to which the one flag AF or BF belongs are regarded as having been destroyed, so that the tone color data area 42 or 44 is cleared. As noted earlier, the value "0" is regarded, in this embodiment, as greater than the value "3".

Note that the flash memory unit 26 employed in the instant embodiment has an "automatic clearing" function which, in response to a clearing instruction given from the CPU 24, allows an internal circuit of the flash memory unit 26 (in this example, the second flash memory) to clear the designated area (i.e., set all the bytes to "FF").

Thus, after the issuance of such a clearing instruction, the CPU 24 can ascertain whether the clearing operation has been completed or not, by referring to an operation flag of the second flash memory within the flash memory unit 26 as necessary. Following step SP84, the subroutine moves on to step SP86 where the write mode variable WM is set to "2" indicating that the flash memory is being cleared, after which the data transfer process subroutine is brought to an end.

Then, when the data transfer process subroutine of FIG. 9 is invoked by way of the play process subroutine of FIG. 5, the data transfer process subroutine proceeds to step SP88 via steps SP80 and SP82. At step S88, a determination is made as to whether a suspension flag SUS is at a value "1" or not. The suspension flag SUS at the value "1" indicates that the clearing operation of the flash memory has been suspended (i.e., under suspension), while the suspension flag SUS at a value "0" indicates that the clearing operation of the flash memory is not under suspension.

The suspension flag SUS is initialized to "0" and is not changed in the value during the above-mentioned various operations. Therefore, a negative (NO) determination is made at step SP88, so that the subroutine goes to step SP92. At step SP92, a reference is made to the tone color data area to which the clearing instruction has been given, so as to determine whether the instructed clearing operation has been completed. If answered in the negative at step SP92, then the data transfer process subroutine of FIG. 9 is brought to an end.

Namely, before the clearing operation is completed, only the operations of steps SP80, SP82 and SP92 are carried out in the data transfer process subroutine, without any substantive operation taking place in the data transfer process subroutine. Then, once the clearing operation is completed, an affirmative (YES) determination is made at step SP92, so that the subroutine goes to step SP94, where the write mode variable WM is set to "3" indicating that data is being copied and a value "0" indicative of a leading address of the cleared tone color data area is set to the write pointer WP.

Thus, next time the data transfer process subroutine of FIG. 9 is invoked, it moves to step SP96 via step SP 82. At step SP96, a predetermined quantity of data are transferred from the tone color data area 32 of the RAM 28 to the cleared tone color data area of the flash memory unit 26 at and after an address thereof pointed to by the write pointer WP. Here, the "predetermined quantity of data" are data that will require a processing time of about 1 msec. Further, at step SP96, the write pointer WP is updated by an amount corresponding to the predetermined quantity of data thus transferred.

After the transfer of the predetermined quantity of data has been completed, the data transfer process subroutine proceeds to step SP98, where a determination is made as to whether or not all the data have been transferred from the tone color data area 32. If answered in the negative at step SP98, the data transfer process subroutine is terminated. After that, each time the data transfer process subroutine is invoked, the operation of step SP96 is executed so that the predetermined quantity of data are transferred from the tone color data area 32 of the RAM 28 to the tone color data area 42 or 44 of the flash memory unit 26.

When the transfer of all the data has been completed, an affirmative determination is made at step SP98, so that the subroutine goes to step SP100. At step SP100, the write mode variable WM is reset to "0" indicating that there is no data to be written into the flash memory unit 26. Further, the flag AF or BF of the tone color data area 42 or 44, to which the data have been transferred in the above-mentioned manner, is set to a value greater by one than the other flag BF or AF. This way, the data transfer process corresponding to the last data change event is completed.

Namely, whenever any one of the data change switches is operated right after detection of an ON event of any one of the pads, the data stored in the RAM 28 are updated in correspondence with the switch operation (step SP72). Then, upon lapse of the transfer wait time ΔT, one of the tone color data areas in the flash memory unit 26 is cleared at step SP84 so that the stored data in the tone color data area 32 of the RAM 28 are sequentially transferred to the cleared tone color data area at step SP96.

The following are two main reasons why the data transfer process is waited or suspended for the transfer wait time ΔT after the occurrence of the data change event or pad-on event.

(1) Generally, there is a limit to the number of times data can be written to the flash memory. To increase the life of the flash memory, it is most effective to reduce the number of data writing to the flash memory. For this purpose, if two or more data change events or the like have occurred in succession at short time intervals (shorter than the transfer wait time ΔT), the data saving operation is effected after the end of the successive events, i.e., after the event occurrence intermits for more than the transfer wait time ΔT.

(2) When a pad-on event has occurred, generation of a corresponding tone has to be started as soon as possible because considerably-delayed generation of the tone will cause the user to feel unnaturalness and discomfort. Thus, the instant embodiment is arranged to suspend the data transfer process right after the pad-on event and thereby suspend the clearing operation so as to permit tone generation based on the waveform data stored in the flash memory. Then, resources are focused on the software tone generator process (steps SP28 and SP118) so that the tone generation can be initiated promptly with a high-quality tone color.

[Play Process (in the Case Where an Event Occurs in the Course of Data Transfer)]

[Pad-on Event When the Write Mode Variable WM is "1" Indicating hat there is Currently a Request for Data Writing]

Next, a description will be made about processes that are performed when a pad-on event or data change event has occurred at various stages of the data transfer process. Once a new pad-on event occurs while the write mode variable WM is "1", i.e. while there is a request for data writing to the flash memory unit 26, the pad-on event process routine of FIG. 6 is invoked.

Then, via the operations of steps SP40 to SP50, the new pad-on event is subjected to a tone generation process in a tone generating channel assigned to the event. At step SP52, the variable CNT is again set to the transfer wait time ΔT. This way, the timing for counting down or decrementing the variable to "0", i.e. the timing for the write mode variable WM to shift from "1" to "2", will be waited.

[Pad-on Event When the Write Mode Variable WM is "2" Indicating that the Flash Memory is Being Cleared]

Once a new pad-on event occurs while the write mode variable WM is "2", an affirmative (YES) determination is made at step SP42 in the pad-on event process routine, so that the process routine goes to step SP44. At step SP44, the clearing operation in the flash memory unit 26 is suspended, and the suspension flag SUS is set to "1". This allows tone generation to be executed based on the waveform data stored in the flash memory while the clearing operation is under suspension.

After tone generation is instructed, the transfer wait time ΔT is again set as the variable CNT at step SP52. Then, once the variable CNT is decremented to "0", the transfer process subroutine of FIG. 9 is invoked, and the subroutine goes to step SP88 by way of steps SP80 and SP82. Because the suspension flag SUS is at "1" this time, the subroutine proceeds to step SP90, where the clearing operation suspended earlier is resumed. Namely, because the tone color data area had already been cleared up to a certain halfway point before the suspension, the clearing operation thus resumed is performed on the remaining portion of the tone color data area following the halfway point. After that, the suspension flag SUS is reset to "0". Thus, the subsequent operations will be performed in a similar manner to the above-described case where no event occurs in the course of data transfer.

[Pad-on Event When the Write Mode Variable WM is "3" Indicating that Data are Being Copied into the Flash Memory]

Once a new pad-on event occurs while the write mode variable WM is "3", the transfer wait time ΔT is set as the variable CNT at step SP52 after assignment of a tone generating channel and issuance of a tone generation instruction, in the manner as stated above.

After that, a negative (NO) determination continues to be made at step SP30 of the play process subroutine (FIG. 5) until the variable CNT is decremented to "0", so that the transfer process subroutine of FIG. 9 is not invoked. Therefore, the data transfer from the RAM 28 to the flash memory unit 26 (step SP96) is temporarily ceased. Then, once the variable CNT turns to the value "0", the transfer process subroutine of FIG. 9 is again invoked, so that the data transfer process is resumed at step SP96. Namely, data following the data already transferred before the temporary cease are transferred at step SP96.

[Data Change Event When Transfer Initialization Condition is Satisfied]

Once a data change event occurs in the course of the data transfer, the data change event process routine of FIG. 8 is invoked. Here, the stored contents of the tone color data area 32 in the RAM 28 are updated via the operations of steps SP70 and SP72, as previously set forth.

Then, at step SP74, a determination is made as to whether the transfer initialization condition is satisfied or not. If the write mode variable WM is "3" indicating that data are being copied and if the write pointer WP is not "0", the above-mentioned transfer initialization condition (b) is satisfied. In short, the satisfaction of the transfer initialization condition means that a change has occurred in tone color data to be transferred after part of the tone color data were transferred to the once-cleared tone color data area.

When it is determined at step SP74 that the transfer initialization condition (b) is satisfied, an affirmative determination is made at step SP74, so that the routine proceeds to step SP76, where the write mode WM is set to "1" to indicate that there is currently a request for data writing to the flash memory. As a consequence, the clearing operation of the flash memory unit 26 will be started again from the beginning.

[Data Change Event When Transfer Initialization Condition is not Satisfied]

Specifically, the transfer initialization condition is not satisfied in one of the following cases where:

(1) the write mode variable WM is "1" or "2"; and (2) the write mode variable WM is "3" and the write pointer WP is "0".

In these cases, an actual tone color data transfer has not yet been initiated at step SP96 although the data transfer process is under way. Therefore, when the data change event process routine of FIG. 8 is invoked, step SP76 is skipped, and the data transfer process continues to be carried out just as before.

[Event Process Responsive to On Event of Address Setting Mode Switch]

Figure 7:
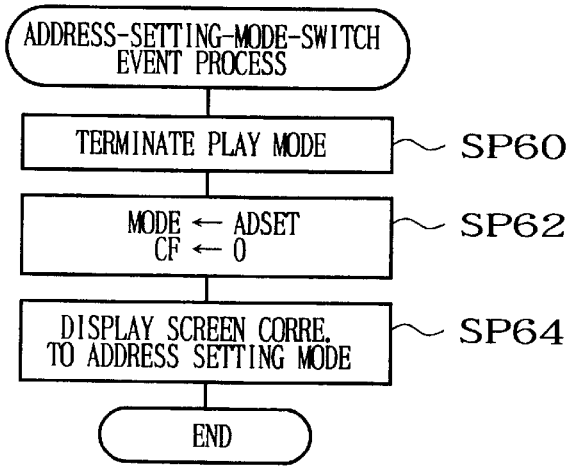
FIG. 7 is a flow chart of an address-setting-mode-switch event process routine carried out when the embodiment is in the play mode.

When an ON event of the address setting mode switch 8*a* is detected at step SP22 of the play process subroutine (FIG. 5), an address-setting-mode-switch event process is carried out at step SP24 as flow charted in FIG. 7. First, at step SP60 of the address-setting-mode-switch event process, an operation is performed on each tone generating channel to deaden or mute a tone being generated thereby. At next step SP62, a value ADSET indicative of the address setting mode is substituted into a variable MODE indicative of an operation mode. At following step SP64, a screen corresponding to the address setting mode is shown on the panel display 6. After that, the address-setting-mode-switch event process is brought to an end.

[Address Setting Process]

Figure 10:
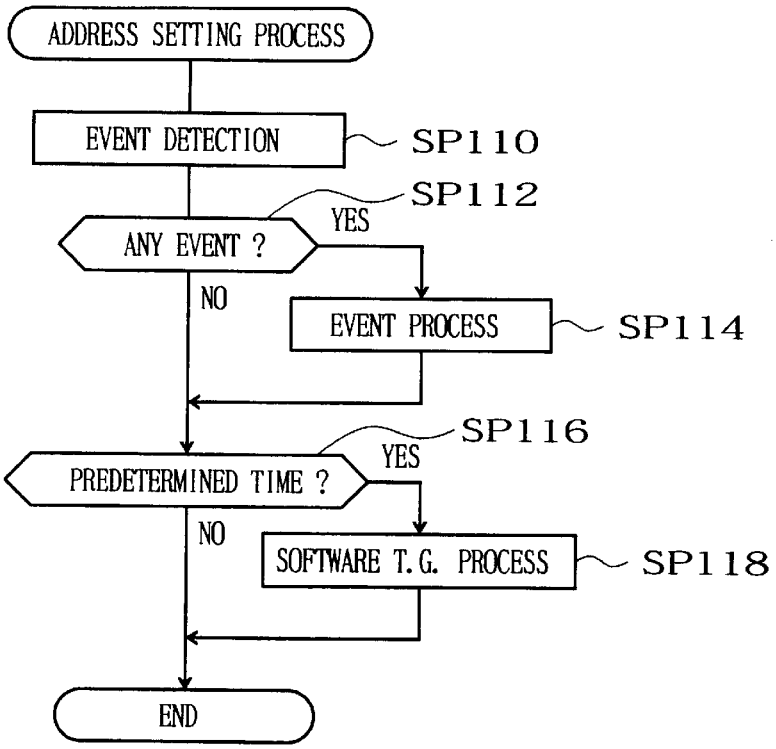
FIG. 10 is a flow chart of an address setting process routine carried out in the play mode.

In the address setting mode, the operation of step SP10 of the main routine (FIG. 4) is executed in a repetitive fashion, and an address setting process routine of FIG. 10 is invoked each time the operation of step SP10 is executed. In the address setting process routine of FIG. 10, operations of steps SP110 to SP118 are carried out in a similar manner to the above-described operations of steps SP20 to SP28 of the play process subroutine (FIG. 5). However, the operation invoked at step SP114 in response to detection of any one of various events is different from the corresponding operation in the play mode. Also, the address setting process routine of FIG. 10 includes no steps corresponding to steps SP30 to SP34 of the play process subroutine (FIG. 5). This is because setting operations take place frequently in the address setting mode and it is inappropriate to transfer the data to the flash memory unit 26 each time such a setting operation takes place. Accordingly, the instant embodiment is arranged in such a manner that the data set in the address setting mode are transferred to the flash memory unit 26 only when the address setting mode is terminated, as will be detailed later. The following paragraphs set forth processes corresponding to various events.

[Pad-on Event Process]

Figure 11:
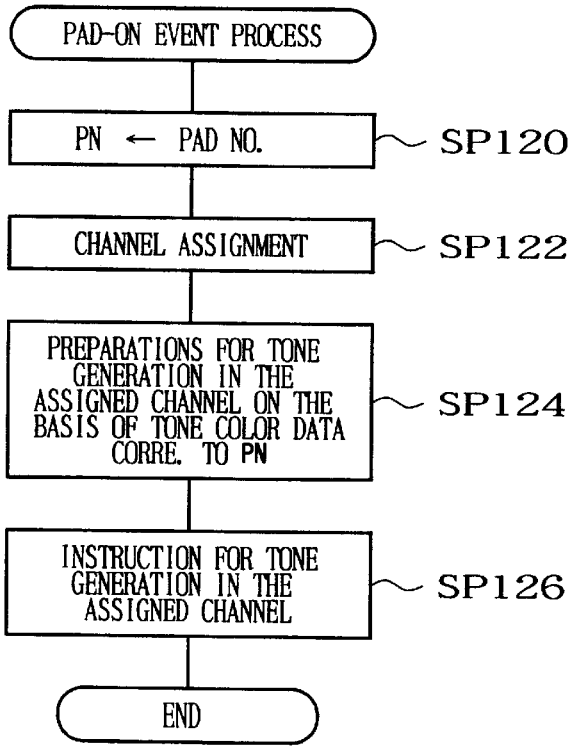
FIG. 11 is a flow chart of a pad-on event process routine carried out when the embodiment is in an address setting mode.

Once a pad-on event in the performance operator unit 2 is detected, a pad-on event process routine of FIG. 11 is invoked at step SP114 of FIG. 10. The pad-on event process routine of FIG. 11 is similar in contents to the pad-on event process routine of FIG. 6. At step SP120, the unique pad number of the last-operated pad is stored in memory. However, the pad-on event process routine of FIG. 11 includes no steps (corresponding to steps SP42, SP44 and SP52 of FIG. 6) which are related to the data transfer to the flash memory unit 26. With the provision of the pad-on event process routine of FIG. 11, the user is allowed to ascertain the tone color any time during the address setting operation by operating any desired one of the pads of the performance operator unit 2 as necessary.

[Address Change Event Process]

Figure 12:
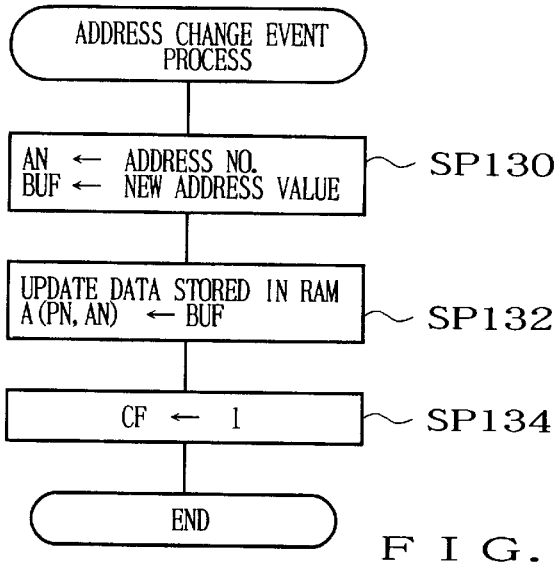
FIG. 12 is a flow chart of an address change event process routine carried out when the embodiment is in the address setting mode.

In the address setting mode, some of the panel switches 8 can be used to set readout addresses of the waveform data. Hereinafter, these switches will be called "address setting switches". Once an event of any one of such address setting switches is detected, an address-change event process routine of FIG. 12 is invoked at step SP114 of FIG. 10.

At step SP130 of the address-change event process routine, an address number is substituted into a variable AN in accordance with the operated address setting switch. Here, the "address number" is a number preset in accordance with the type of the address; for example, a start address for starting waveform address is allocated an address number "0", a loop start address to function as a leading or start address of a loop portion is allocated an address number "1", a loop end address to function as a last or end address of a loop portion is allocated an address number "2", and so on.

Further, at step SP130, a changed address is stored into the buffer area of the RAM 28. At next step SP132, the address value thus temporarily stored in the buffer area is transferred to an address value A (PN, AN). Here, the "address value A (PN, AN)" represents an address value of the address number AN for a pad of the pad number PN. As noted earlier, the pad number PN represents a pad of which an ON event has been detected last.

At step SP134, a change flag CF is set to a value "1". The change flag CF is a flag indicating that some address change process has been executed, which is set to "0" at the initial stage. After completion of the operations of those steps, the address-change event process routine is brought to an end.

[Play Mode Switch Event Process]

Figure 13:
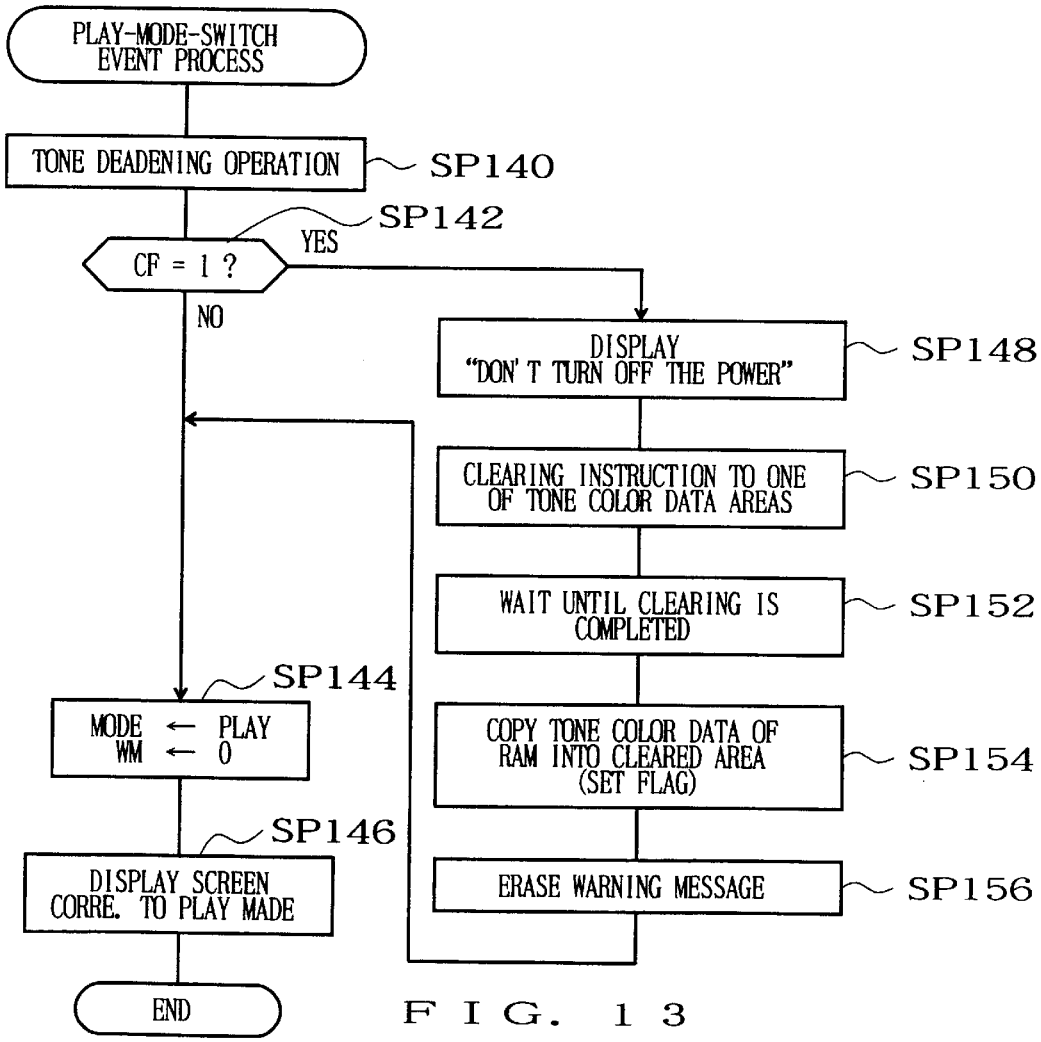
FIG. 13 is a flow chart of a play-mode-switch event process routine carried out when the embodiment is in the address setting mode.

Upon completion of the waveform data address setting operation, the user depresses the play mode switch 8*b*. Once such an event of the play mode switch 8*b* is detected, a play-mode-switch event process routine of FIG. 13 is started up at step SP114 of the address setting process routine of FIG. 11.

At step SP140 of the play-mode-switch event process routine, a tone deadening operation is performed on the channel currently generating a tone. At next step SP142, a determination is made as to whether the change flag CF is currently at a value "1". If answered in the affirmative, the routine goes to step SP148, where a warning message "Don't Turn off the Power" is shown on the panel display 6.

At following step SP150, a reference is made to the flags AF and BF, and a clearing instruction is given to one of the tone color data areas 42 and 44. If a value in the range of "0" to "3" has not been set in one of the flags AF and BF, the data stored in the tone color data area 42 or 44 to which the one flag AF or BF belongs are regarded as having been destroyed, so that tone color data area 42 or 44 is cleared. If, on the other hand, the flags AF and BF have both been set to values in the range of "0" to "3", then the tone color data area 42 or 44 whose flag AF or BF is smaller in value than the other flag BF or AF is cleared. As noted earlier, the value "0" is regarded as greater than the value "3".

At next step SP152, a reference is made to the stored contents of the flash memory unit 26 as necessary, and the process waits until the clearing operation is completed. After that, the routine moves on to step SP154, where the data stored in the tone color data area 32 are copied into the cleared tone color data area of the flash memory unit 26. After completion of the data copying, the flag AF or BF of the tone color data area 42 or 44, to which the data have been transferred, is set to a value greater by one than the other flag BF or AF. Also, the change flag CF is set to "0".

Then, at step SP156, the warning message shown at step SP148 is erased from the panel display 6. In the event that the change flag CF is already "0" when the play mode switch 8*b* is operated (i.e., no change has been made to the address value), the operations of steps SP148 to SP156 are skipped.

At step SP144, a value indicative of the play mode is substituted into the operation mode variable MODE. At next step SP146, a screen corresponding to the play mode is shown on the panel display 6. After execution of the operations of those steps, the play-mode-switch event process routine of FIG. 13 is brought to an end. Afterwards, the operations described above in relation to the play mode are again repeated.

[Modifications]

The present invention should not be construed as limited to the above-described embodiment, and various other embodiments or modifications of the invention are also possible as follows.

(1) In the above-described embodiment, values cyclically incremented values within the range of "0", "1", "2" and "3" are alternately stored into the flags AF and BF, the value setting in the flags AF and BF is not limited to this. For example, three bits of the flags AF and BF may be caused to turn to "1" after cyclically changing like "001", "010", "100", "001", . . . , Further, text codes, changing like "A", "B", "C", "D", "A", "B", . . . , may be stored in the flags AF and BF.

(2) Whereas the described embodiment uses the flash memory unit 26, another type of non-volatile storage device may be used, such as a magnetic disk, magneto-optical disk, or memory backed up by a battery.

(3) Whereas the present invention has been described as embodied as an electronic musical instrument requiring no other particular hardware, the above-described processes may be prestored in a storage medium such as a floppy disk or CD-ROM so that these processes can be executed on a general-purpose computer.

In summary, the present invention is characterized primarily in that tone control data, such as tone color data, are transferred to the non-volatile storage device in response to a setting operation of the data in such a manner that the data are stored alternately into the first and second storage areas of the non-volatile storage device along with identification information identifying the newest data, and also in that the data transfer is suspended on condition that there has been detected a performance event. With such arrangements, the present invention can save the tone control data into the non-volatile storage device safely and reliably while still maintaining high tone quality.

Further, when a change is made to the tone control data, the present invention allows a tone to be generated, using the changed tone control data, immediately after the change. Thus, it is possible to prevent the backup operation for saving the tone control data from disturbing the tone generation. As a consequence, a tone generation process with a good response capability is achieved.

Furthermore, even when the power is turned off in the course of backup copying of the tone control data, the present invention permits use of previously backup-copied tone control data.

Furthermore, the present invention can significantly reduce the number of transfers of the tone control data from the first storage device to the second storage device. Thus, control-related loads and power consumption can be lowered to a significant degree. Additionally, even in the case where the second storage device is a flash memory or the like that can be written only a limited number of times, the present can effectively prolong the life of the second storage device.

Moreover, the present invention can avoid the backup operation while subtle adjustment is made in an adjustment mode, and then allows the instructed backup operation to be automatically performed as the adjustment mode is terminated.

What is claimed is:

1. A method for managing saving of tone control data, said method comprising the steps of:

receiving a performance event;

instructing, in accordance with the performance event received by said step of receiving, generation of a tone based on tone control data stored in a first storage device;

receiving a setting event;

changing, in accordance with the received setting event, the tone control data stored in said first storage device; and transferring, within an idle time period when operations by said steps are not being carried out, the tone control data, changed by said step of changing, from said first storage device to a non-volatile second storage device.

2. A method as claimed in claim 1 wherein the tone control data is tone color data.

3. A method for managing saving of tone control data, said method comprising the steps of:

updating tone control data stored in a first storage device;

tranferring the updated tone control data stored in the first storage device into a non-volatile second storage device in order in which the tone control data have been updated by said step of updating, so as to store a plurality of sets of the updated tone control data in the second storage device; and storing, into said second storage device, identification information indicative of a newest one of the plurality of sets of the updated tone control data stored in said second storage device.

4. A method as claimed in claim 2 wherein the tone control data is tone color data.

5. A method for managing saving of tone control data, said method comprising the steps of:

updating tone control data stored in a first storage device;

transferring the tone control data, updated by said step of updating, to a non-volatile second storage device;

receiving a performance event;

suspending, in response to reception of the performance event, a transfer of the tone control data being carried out by said step of transferring at the time of the reception of the performance event;

instructing, in accordance with the received performance event, generation of a tone based on the tone control data stored in said first storage device; and resuming the transfer of the tone control data suspended by said step of suspending, after completion of the tone generation corresponding to the performance event.

6. A method as claimed in claim 5 wherein the tone control data is tone color data.

7. A method for managing saving of tone control data, said method comprising the steps of:

receiving a setting event;

changing, in accordance with the setting event received by said step of receiving, tone control data stored in a first storage device; and transferring the tone control data, changed by said step of changing, from said first storage device to a non-volatile second storage device, on condition that reception of the setting event has intermitted for more than a predetermined time.

8. A method as claimed in claim 7 wherein the tone control data is tone color data.

9. A method as claimed in claim 7 which further comprises a step of, when the setting event is received by said step of receiving while the tone control data changed by said step of changing is being transferred by said step of transferring, suspending a transfer of the changed tone control data by said step of transferring, and also destroying the tone control data already transferred to said second storage device, and wherein said step of transferring, when new tone control data is to be transferred after suspension of the tone control data by said step of suspending, the new data into an area of said second storage device where the destroyed data has so far been stored.

10. A method for managing saving of tone control data in an apparatus using the tone control data, said method comprising the steps of:

selecting one operation mode of said apparatus from among a plurality of operation modes including a setting mode, wherein said apparatus operates in the operation mode selected by said step of selecting:

receiving a setting event while said apparatus is operating in the setting mode selected by said step of selecting; and changing, in accordance with the setting event received by said step of receiving, tone control data stored in a volatile first storage device while said apparatus is operating in said setting mode selected by said step of selecting; and transferring the tone control data, changed by said step of changing, from said first storage device to a non-volatile second storage device, when said operation mode is selected by said step of selecting is changed from said setting mode to another one of the operation modes.

11. A method as claimed in claim 10 wherein the tone control data is tone color data.

12. A machine-readable storage medium containing a group of instructions to cause said machine to implement a method for managing saving of tone control data, said method comprising the steps of:

receiving a performance event;

instructing, in accordance with the performance event received by said step of receiving, generation of a tone based on tone control data stored in a first storage device;

receiving a setting event;

changing, in accordance with the received setting event, the tone control data stored in said first storage device; and transferring, within an idle time period when operations by said steps are not being carried out, the tone control data, changed by said step of changing, from said first storage device to a non-volatile second storage device.

13. A machine-readable storage medium containing a group of instructions to cause said machine to implement a method for managing saving of tone control data, said method comprising the steps of:

updating tone control data stored in a first storage device;

transferring the updated tone control data stored in the first storage device into a non-volatile second storage device in order in which the tone control data have been updated by said step of updating, so as to store a plurality of sets of the updated tone control data in the second storage device; and storing, into said second storage device, identification information indicative of a newest one of the plurality of sets of the updated tone control data stored in said second storage device.

14. A machine-readable storage medium containing a group of instructions to cause said machine to implement a method for managing saving of tone control data, said method comprising the steps of:

updating tone control data stored in a first storage device;

transferring the tone control data, updated by said step of updating, to a non-volatile second storage device;

receiving a performance event;

suspending, in response to reception of the performance event, a transfer of the tone control data being carried out by said step of transferring at the time of the reception of the performance event;

instructing, in accordance with the received performance event, generation of a tone based on the tone control data stored in said first storage device; and resuming the transfer of the tone control data suspended by said step of suspending, after completion of the tone generation corresponding to the performance event.

15. A machine-readable storage medium containing a group of instructions to cause said machine to implement a method for managing saving of tone control data, said method comprising the steps of:

receiving a setting event;

changing, in accordance with the setting event received by said step of receiving, tone control data stored in a first storage device; and transferring the tone control data, changed by said step of changing, from said first storage device to a non-volatile second storage device, on condition that reception of the setting event has intermitted for more than a predetermined time.

16. A machine-readable storage medium containing a group of instructions to cause said machine to implement a method for managing saving of tone control data in an apparatus using the tone control data, said method comprising the steps of:

selecting one operation mode of said apparatus from among a plurality of operation modes including a setting mode, wherein said apparatus operates in the operation mode selected by said step of selecting;

receiving a setting event while said apparatus is operating in the setting mode selected by said step of selecting;

changing, in accordance with the setting event received by said step of receiving, tone control data stored in a volatile first storage device while said apparatus is operating in said setting mode selected by said step of selecting; and transferring the tone control data, changed by said step of changing, from said first storage device to a non-volatile second storage device, when said operation mode selected by said step of selecting is changed from said setting mode to another one of the operation modes.

17. A tone control apparatus comprising:

a first storage device adapted to store tone control data;

a non-volatile second storage device adapted to store tone control data;

a performance event generation device adapted to generate a performance event;

an input device adapted to generate a setting event for setting or changing tone control data; and a processor device coupled with said first and second storage devices, said performance event generation device and said input device, said processor device being adapted to:

receive the performance event;

instruct, in accordance with the received performance event, generation of a tone based on the tone control data stored in said first storage device;

receive a setting event;

change, in accordance with the received setting event, the tone control data stored in said first storage device; and transfer, within an idle time period when said processor device is not being engaged in any other operation, the changed tone control data from said first storage device to a non-volatile second storage device.

18. A tone control apparatus comprising:

a first storage device adapted to store tone control data;

a non-volatile second storage device adapted to store tone control data; and a processor device coupled with said first and second storage devices and adapted to:

update the tone control data stored in said first storage device;

transfer the updated tone control data stored in the first storage device into said non-volatile second storage device in order in which the tone control data have been updated so as to store a plurality of sets of the updated tone control data in the second storage device; and store, into said second storage device, identification information indicative of a newest one of the plurality of sets of the updated tone control data stored in said second storage device.

19. A tone control apparatus comprising:

a first storage device adapted to store tone control data;

a non-volatile second storage device adapted to store tone control data;

a performance event generation device adapted to generate a performance event; and a processor device coupled with said first and second storage devices and said performance event generation device, said processor device being adapted to:

update the tone control data stored in said first storage device;

transfer the updated tone control data to said non-volatile second storage device;

receive a performance event;

suspend, in response to reception of the performance event, a transfer of the updated tone control data being carried out at the time of the reception of the performance event;

instruct, in accordance with the received performance event, generation of a tone based on the tone control data stored in said first storage device; and resume the suspended transfer of the tone control data, after completion of the tone generation corresponding to the performance event.

20. A tone control apparatus comprising:

a first storage device adapted to store tone control data;

a non-volatile second storage device adapted to store tone control data;

an input device adapted to generate a setting event for setting or changing tone control data; and a processor device coupled with said first and second storage devices and said input device, said processor device being adapted to:

receive a setting event;

change, in accordance with the received setting event, tone control data stored in said first storage device; and transfer the changed tone control data from said first storage device to said non-volatile second storage device, on condition that reception of the setting event has intermitted for more than a predetermined time.

21. A tone control apparatus comprising:

a volatile first storage device adapted to store tone control data;

a non-volatile second storage device adapted to store tone control data;

a selector adapted to select one operation mode of said apparatus from among a plurality of operation modes including a setting mode, wherein said apparatus operates in the operation mode selected by said selector;

an input device adapted to generate a setting event for setting or changing tone control data; and a processor device coupled with said first and second storage devices and said input device, said processor device being adapted to:

receive a setting event while said apparatus is operating in the setting mode selected by said selector;

change, in accordance with the received setting event, the tone control data stored in said volatile first storage device while said apparatus is operating in said setting mode selected by said selector; and transfer the changed tone control data from said first storage device to said non-volatile second storage device, when said operation mode selected by said selector is changed from said setting mode to another one of the operation modes.

* * * * *